US009518441B2

(12) United States Patent
Porta

(10) Patent No.: US 9,518,441 B2
(45) Date of Patent: Dec. 13, 2016

(54) EXPANDABLE PACKING ELEMENT AND CARTRIDGE

(71) Applicant: FREUDENBERG OIL & GAS, LLC, Plymouth, MI (US)

(72) Inventor: Santiago Galvez Porta, Peterhead (GB)

(73) Assignee: FREUDENBERG OIL & GAS, LLC, Plymouth, MI (US)

( * ) Notice: Subject to any disclaimer, the term of this patent is extended or adjusted under 35 U.S.C. 154(b) by 799 days.

(21) Appl. No.: 13/888,859

(22) Filed: May 7, 2013

(65) Prior Publication Data

US 2014/0332239 A1 Nov. 13, 2014

(51) Int. Cl.
*E21B 33/128* (2006.01)
*E21B 33/12* (2006.01)
*E21B 33/129* (2006.01)

(52) U.S. Cl.
CPC ..... *E21B 33/1285* (2013.01); *E21B 33/128* (2013.01); *E21B 33/1208* (2013.01); *E21B 33/1293* (2013.01)

(58) Field of Classification Search
CPC .... E21B 33/12; E21B 33/128; E21B 33/1285; E21B 33/1208; E21B 33/1293; E21B 23/06
See application file for complete search history.

(56) References Cited

U.S. PATENT DOCUMENTS 2,189,703 A * 2/1940 Burt ..... E21B 33/12 166/114
3,991,826 A 11/1976 Baugh
4,433,847 A * 2/1984 Weinberg ..... E21B 33/1208 277/342
4,452,463 A * 6/1984 Buckner ..... E21B 33/1216 166/196
5,311,938 A 5/1994 Hendrickson et al.
6,244,642 B1 6/2001 Serafin et al.
6,959,759 B2 11/2005 Doane et al.
2008/0296845 A1 12/2008 Doane
2009/0242215 A1* 10/2009 Eatwell ..... E21B 33/1285 166/387
2010/0132960 A1* 6/2010 Shkurti ..... E21B 33/134 166/387
2010/0139911 A1* 6/2010 Stout ..... E21B 17/026 166/119

OTHER PUBLICATIONS

International Search Report from corresponding PCT Appln. No. PCT/US2014/-31742 dated Aug. 11, 2014.

* cited by examiner

*Primary Examiner* — Robert E Fuller
*Assistant Examiner* — David Carroll
(74) *Attorney, Agent, or Firm* — Grossman, Tucker, Perreault & Pfleger, PLLC

(57) ABSTRACT

A packing element comprising a tube having a longitudinal length. The tube includes a first end and a second end opposing the first end, an external portion including a plurality of circumferential ribs, and an internal portion opposing the external portion. The internal portion of the tube includes i) a central portion extending along a portion of the longitudinal length of the tube between the first end and second end of the tube, wherein the central portion includes a relief, ii) a first tapered portion radially tapering along the longitudinal length from the central portion towards the first end, and iii) a second tapered portion tapering along the longitudinal length from the central portion towards the second end.

28 Claims, 16 Drawing Sheets

EXPANDABLE PACKING ELEMENT AND CARTRIDGE

FIELD OF INVENTION

The present disclosure is related to expandable packing elements, packing element cartridge, and methods of deploying packing element cartridge in sealing oil and gas wells.

BACKGROUND

Packers are commonly used in the oil and gas industry for drilling, intervention or well completion systems to provide a seal between the outside of production tubing and the inside of a wellbore wall, which may be open or include a casing or liner. A packer generally includes a sealing device, a holding or setting device, and an inside passage for fluids. Packer elements, i.e., a part of the sealing device, encircle the packing element cartridge and are designed to expand against casing or wellbore wall. The packing elements are commonly made of elastomers, which may limit their low and high temperature ratings as well as chemical resistance. Parts forming a packing assembly, i.e., the tools used in running and setting a packer, are designed to be mounted as separate parts in situ. This results in relatively complex assembly procedures and requires specialized personnel. Field re-dress, consequently, may become relatively difficult.

Due to the limited amount of expansion that packer elements are generally capable of, it is normal that packer elements of more than one size in outer diameter are necessary to seal casings of various weight ranges. Seal performance may also be improved using anti-extrusion parts, such as springs, or other low expansion backup systems to improve sealing. Accordingly, packer design may be weight range specific, requiring tool changes when the packers are run and set in various casing weight ranges. While expandable packing elements, such as inflatable, swellable and cup seals, are available for a wide range of seal bore sizes, they have relative low pressure ratings, limiting their application. In addition, such expandable elements may not be retrievable.

Therefore, room remains for the improvement of packing elements and packing element subassemblies, particularly in expandability, pressure rating, temperature rating, retrieveability and ease of use.

SUMMARY

An aspect of the present disclosure relates to a packing element comprising a tube having a longitudinal length. The tube includes a first end and a second end opposing the first end, an external portion including a plurality of circumferential ribs, and an internal portion opposing the external portion. The internal portion of the tube includes i) a central portion extending along a portion of the longitudinal length of the tube between the first end and second end of the tube, wherein the central portion includes a relief, ii) a first tapered portion radially tapering along the longitudinal length from the central portion towards the first end of the tube, and iii) a second tapered portion tapering along the longitudinal length from the central portion towards the second end of the tube.

Another aspect of the present disclosure relates to a packing element cartridge. The packing element cartridge includes a tubular housing having a longitudinal length and a mandrel including a first ramped surface and a first portion that is positioned within the tubular housing and is slidable longitudinally relative to the tubular housing. In addition, the tubular housing includes a second ramped surface opposing the first ramped surface of the tubular housing. A packing element, as described above, is disposed around the mandrel, wherein the first proximal portion and the second proximal portion of the packing element slidably contact the ramped surfaces. Upon moving the mandrel longitudinally into the tubular housing, a distance between the ramped surfaces decreases and the tapered portions of the packing element slide up the ramped surfaces, radially expanding the packing element. Upon moving the mandrel longitudinally out from the tubular housing, the distance between the ramped surfaces increases and the tapered portions of the packing element slide down the ramped surfaces, radially contracting the packing element.

A further aspect of the present disclosure relates to a method of deploying a packing element cartridge. The method includes running a packing element cartridge between a wellbore and production pipe and moving the mandrel longitudinally into said tubular housing. Upon moving the mandrel longitudinally into the tubular housing, a distance between the ramped surfaces of the mandrel and tubular housing decreases and the tapered portions of the packing element described above slide up the ramped surfaces, radially expanding the packing element.

Yet an additional aspect of the present disclosure relates to a well bore including a well bore annulus and a packing element cartridge placed within said annulus. The packing element cartridge includes a tubular housing having a longitudinal length and a mandrel including a first ramped surface and a first portion that is positioned within the tubular housing and is slidable longitudinally relative to the tubular housing. In addition, the tubular housing includes a second ramped surface opposing the first ramped surface of the tubular housing. A packing element, as described above, is disposed around the mandrel, wherein the first proximal portion and the second proximal portion of the packing element slidably contact the ramped surfaces. Upon moving the mandrel longitudinally into the tubular housing, a distance between the ramped surfaces decreases and the tapered portions of the packing element slide up the ramped surfaces, radially expanding the packing element. Upon moving the mandrel longitudinally out from the tubular housing, the distance between the ramped surfaces increases and the tapered portions of the packing element slide down the ramped surfaces, radially contracting the packing element.

BRIEF DESCRIPTION OF DRAWINGS

The above-mentioned and other features of this disclosure, and the manner of attaining them, may become more apparent and better understood by reference to the following description of embodiments described herein taken in conjunction with the accompanying drawings, wherein.

DETAILED DESCRIPTION

In light of the above, the present application is directed to packing elements, packing element cartridges including packing elements, and methods of deploying packing element cartridges in sealing oil and gas wells. The cartridges may be used as stand-alone devices or form a part of downhole tools. The packing element cartridges are run in between a wellbore, i.e., the open hole drilled through the earth, and production pipe, i.e., the pipe used to extract the oil or gas. In embodiments, casings or liners are present in the wellbores and the packing element cartridges are run in between the casings or liners and the production pipe. The packing element cartridges herein are adaptable to a variety of bore sizes such as, for example, wellbores having a diameter in the range of 5.75 to 12.0 inches (nominal), including all values and ranges therein, such as 5.875 inches to 6.30 inches, 6.125 inches, 8.5 inches, 9.25 inches, 9.625 etc. For liner packers, the diameter may be in there range of 6 inches to 6.5 inches, covering 7 inch liner weights from 20 lb/ft to 32 lb/ft, including all values and ranges therein. The packing element cartridge may provide relatively high expansion, in the range of 10% to 20% relative to the gauge diameter, including all values and ranges therein, and pressure ratings of at least 10 ksi to 25 ksi, including all values and ranges therein.

Figure 1A:
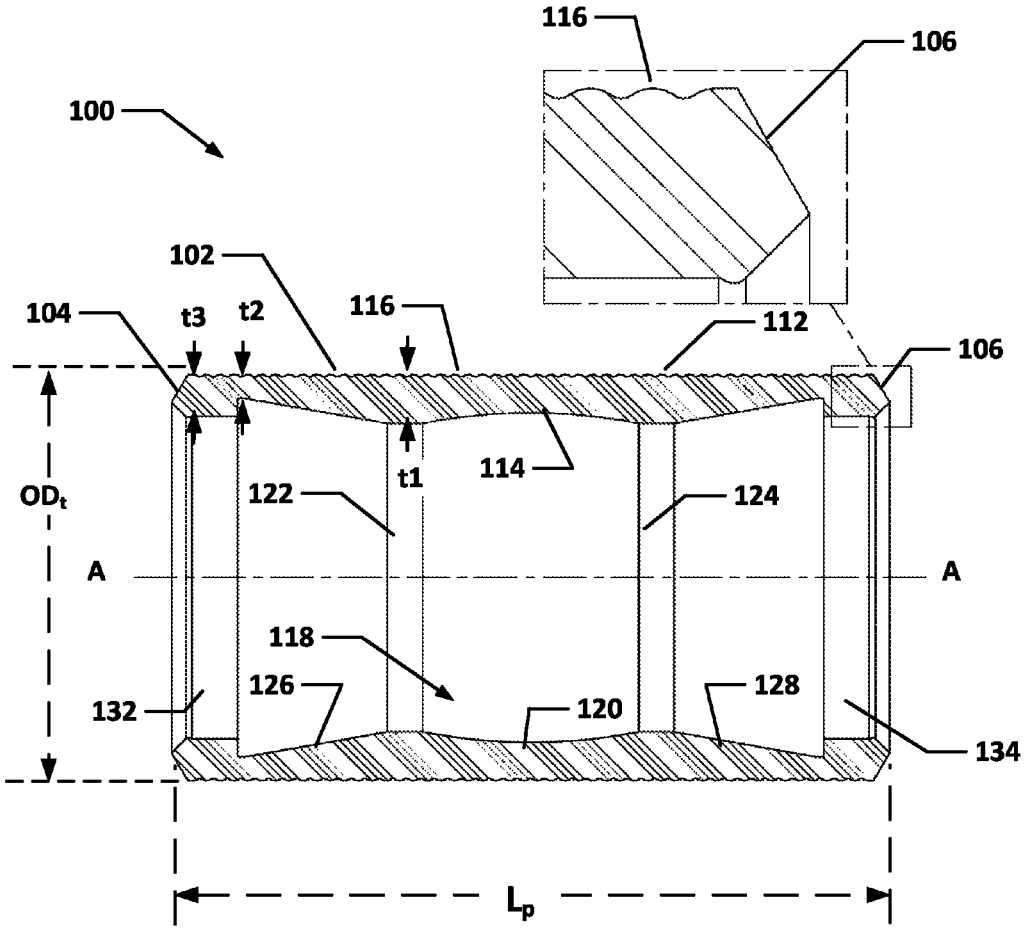
FIG. 1*a* illustrates a longitudinal cross-section of an embodiment of a packing element having a first configuration that may be employed in non-retrievable packer element cartridges.
Figure 1B:
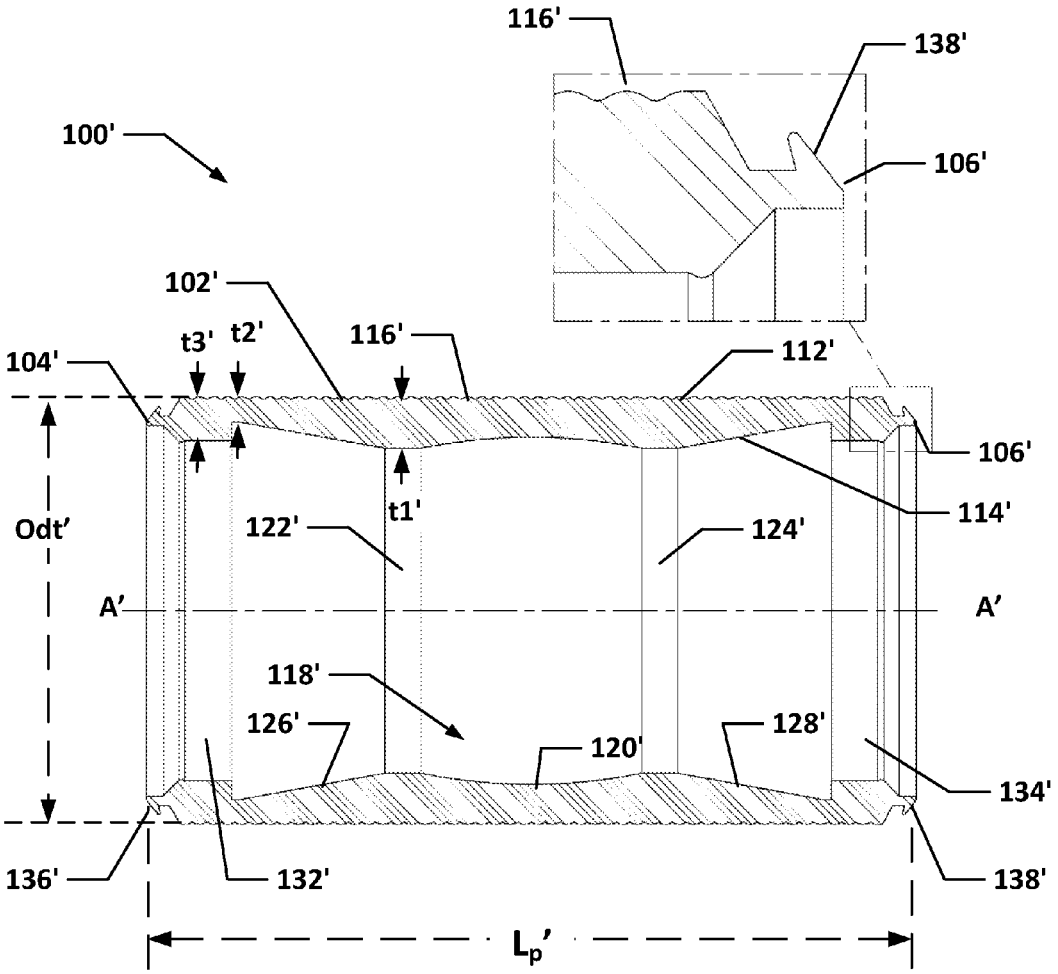
FIG. 1*b* illustrates a longitudinal cross-section of an embodiment of a packing element having a second configuration that may be employed in retrievable packer element cartridges.
Figure 2:
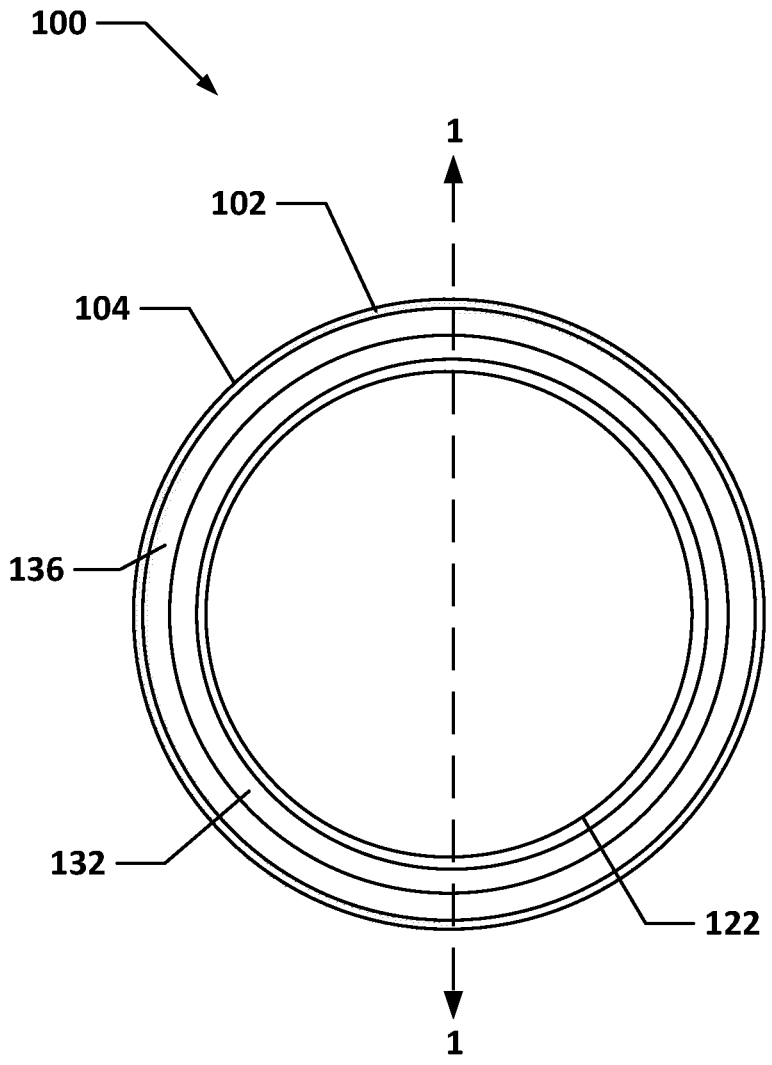
FIG. 2 illustrates a side view of the packing element of FIG. 1*b;*

FIGS. 1*a*, 1*b*, and 2 illustrate embodiments of a packing element 100 for use in a packing element cartridge, wherein FIGS. 1*a* and 1*b* illustrate cross-sectional views of a packing elements and FIG. 2 illustrates a side view through which the cross-section 1-1 was taken of FIG. 1*b*. The packing element of FIG. 1*a* may be used in a non-retrievable or permanent cartridge and the packing element of FIG. 1*b* may be used in a retrievable cartridge. Note that the reference numbers common to the embodiments are held constant, but distinguished by "'". The packing element includes a tube 102 having a longitudinal length Lp and defining a central axis A-A. The tube 102 includes a first end 104 and a second end 106 opposing the first end 104. In addition, the tube 102 includes an external portion 112 and an internal portion 114. The overall length of the tube may be in the range of 5 inches to 15 inches, including all values and ranges therein. Further, the length Lp to outer diameter $OD_t$ ratio of the tube may be in the range of 1.0 to 3.0 including all values and ranges therein, such as 1.77. That is: $Lp=x*OD_t$, wherein x is from 1.0 to 3.0.

The external portion 112 of the tube 102, forming the outer surface of the tube 102, may include a plurality of ribs 116, each extending partially or completely around the tube in a circumferential manner, arranged along the length of the tube 102. Alternatively, the ribs 116 may be formed from one or more ribs wrapped spirally or radially around the tube 102. As illustrated, the ribs 116 are formed along the entire length $L_p$ of the tube 102. However, in embodiments, the ribs may be spaced along the length of the tube and flat surfaces may be present from which the ribs extend.

The internal portion 114 of the tube 102 opposes the external portion or surface 112, forming the inner surface of the tube 102. The internal portion 114 includes a central portion 118, which extends along the longitudinal length Lp of the tube 102 between the first end 104 and the second end 106. In preferred embodiments, the central portion 118 includes a relief 120 formed radially in the surface around axis A-A and may be concave. The relief 120 may have a length that is 15% to 45% of the total length of the tube, including all values and ranges therein, such as 30%. In addition, the relief may have a radius of curvature in the range of 3 inches to 10 inches. The relief 120 may promote greater expansion of the packing element 100, when it is deployed in the wellbore. Furthermore, the relief 120 may allow tension on the sealing element to cause the packing element 100 to collapse.

The central portion 118 may also include lands 122, 124 on either side of the relief. The lands may individually exhibit a length in the range of 2% to 7% of the tube. Including all values and ranges therein. The internal portion 114 also includes opposing tapered portions, i.e., a first tapered portion 126 and a second tapered portion 128 wherein the thickness of the tube 102 is reduced (see t1 and t2) extending along the longitudinal length away from the central portion 118 and towards the first end 104 and second end 106. The length of the tapers may each be in the range of 10% to 30% of the length Lp of the packing element, including all values and ranges therein. Furthermore, the tapers result in a thickness reduction of 25% to 75%, wherein the thickness at the land t1 is greater than the thickness of the taper near the ends of the tube t2, and t2=y*t1, wherein y is in the range of 0.25 to 0.75, including all values and increments therein, such as 0.5. In embodiments, the tapers 126, 128 are radial, i.e., that is the taper is defined around axis A-A.

In addition, the internal portion of the tube 102 may also include collars, i.e., a first collar 132 and a second collar 134, at the opposing ends 104, 106 of the tube 102. The collars may exhibit a thickness t3 of 70% to 90% relative to the lands t1, wherein t2=z*t3, wherein z is in the range of 0.7 to 0.9, including all values and ranges therein and t3>t2. The thinnest portion of the relief, exhibits a 35% to 45% reduction in thickness relative to the collar. The collars may also exhibit a length of 5% to 10% of Lp.

In addition to the features described above, in embodiments such as illustrated in FIG. 1*b*, circumferential hook latch profiles 136' and 138' extend from the ends 104', 106' of the tube 102' around the circumference of the tube 102'.

The hook latch profiles may individually have a length in the range of 1% to 5% of the total length of the packing element Lp', including all values and ranges therein, such as 2%. The hook latch profiles allow for, or improve, the application of tension to the tube to collapse and retrieve the packing element tube after it has been deployed.

In any embodiment, the tube 102 is formed from elastomers. In addition, or alternatively, the tube is formed from fluoropolymers. Examples of materials include polytetrafluoroethylene (PTFE), nitrile butadiene rubber (NBR), hydrogenated nitrile butadiene rubber (HNBR), fluoroelastomer (FKM) such as VITON, perfluoroelastomer (FFKM) such as KALREZ, ethylene-propylene-diene-monomer (EPDM), and tetrafluoroethylene-propylene (TFE/P). In preferred embodiments, PTFE or fluoroelastomers are used as they may provide additional heat and chemical resistance. The tubes may be formed by machining or from a number of molding methods, including melt flow processes wherein at least a portion of the polymer material is caused to flow under heat and pressure. These processes may include, for example, injection molding, compression molding, transfer molding, etc.

As noted above, the packing elements are employed in downhole tools to create a seal in the annulus between the tool and the borehole. In one embodiment, illustrated in FIGS. 3*a* and 3*b*, the packing element cartridge 300 is placed within an annulus 301 defined within a well bore 303, between the bore itself and a production pipe 400, or between a casing and a production pipe, or between multiple casings. The packing element cartridge 300 includes a tubular housing 310 and a mandrel 312, a portion of which is slidably received in the tubular housing 310. The tubular housing and mandrel may be formed of low alloy steel, such as AISI 4140. In addition, other materials may be used as well such as S13Cr stainless steel, L80 steel, 13% Cr steel, INCONEL 718, etc. In embodiments, the tubular housing 310 defines an expanded bore 311 having a larger diameter Db than the diameter Dth of the remainder of the tubular housing 310, which receives the mandrel 312. Bore 311 may be open to the inner diameter of the tubular housing 310 forming a portion of the interior surface 318 and a shelf 319 on the interior surface as illustrated. Alternatively, an elongated channel may be provided, wherein a wall separates the elongated channel from the inner diameter of the tubular housing and the wall forms the interior surface. The mandrel also includes an elongated hollow shaft 313 that fits within the expanded bore 311, between the interior surface 318 of the tubular housing 310 and the production pipe 400.

The mandrel 312 slides longitudinally, telescopically collapsing, at least in part, further into the tubular housing 310 when the packing element cartridge 300 set into place in the wellbore and set. When deployed, the mandrel 312 collapses and moves longitudinally along axis B-B into the tubular housing 310, reducing the length of the packing element cartridge 300. For example, the setting stroke Ss, the distance that the mandrel travels into the tubular housing, may be up to 20% of the overall length Lt of the packing element cartridge 300 when fully expanded, including all values and ranges therein.

In embodiments, the exterior surface 314 of the tubular housing includes radial taper 316 extending around central axis B-B of the packing element cartridge 300, which may be concentric with the central axis of the packing element A-A. In addition, the taper 316 extends towards interior surface 318 and the central portion 320 of the packing element cartridge. In such a manner a first end 322 of the tubular housing 310 has a smaller thickness than the opposing second end 324. The exterior surface 328 of the mandrel 312 also includes a taper 330 around the radius of the mandrel 312 extending towards the interior surface 332 and central portion 320 of the packing element cartridge forming the elongated hollow shaft 313. The tapers 316, 330 are disposed at opposing angles α, β, respectively, in the range of 5° to 15° relative to the central axis B-B, including all values and increments therein, such as 10°. Angles α, β may be equal or different.

Figure 4:
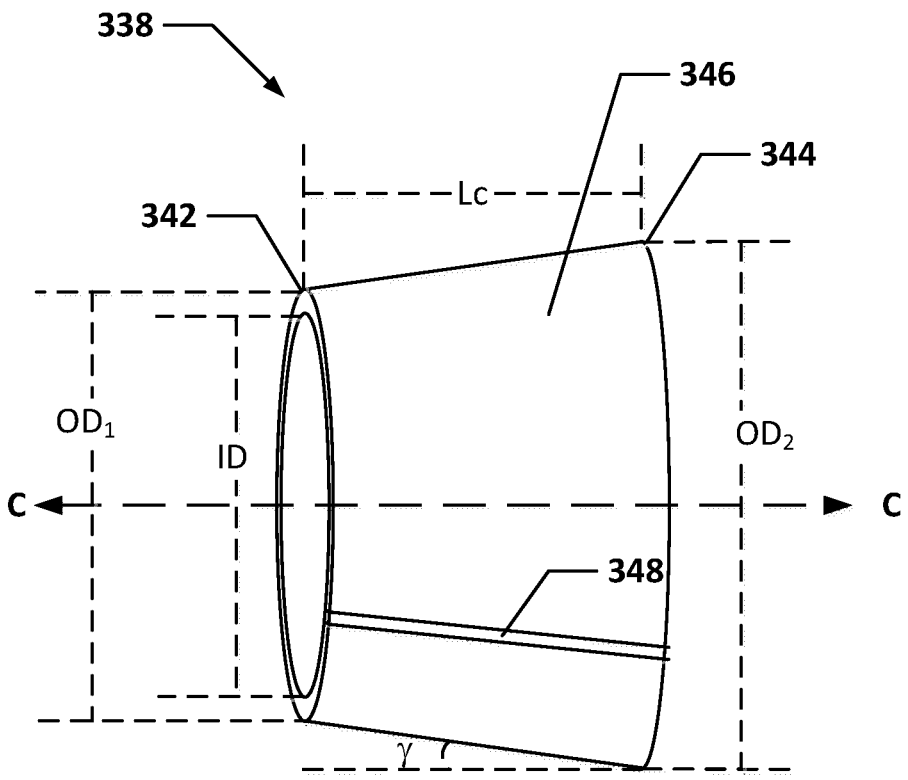
FIG. 4 illustrates a side view of an embodiment of a tapered split cone.
Figure 5:
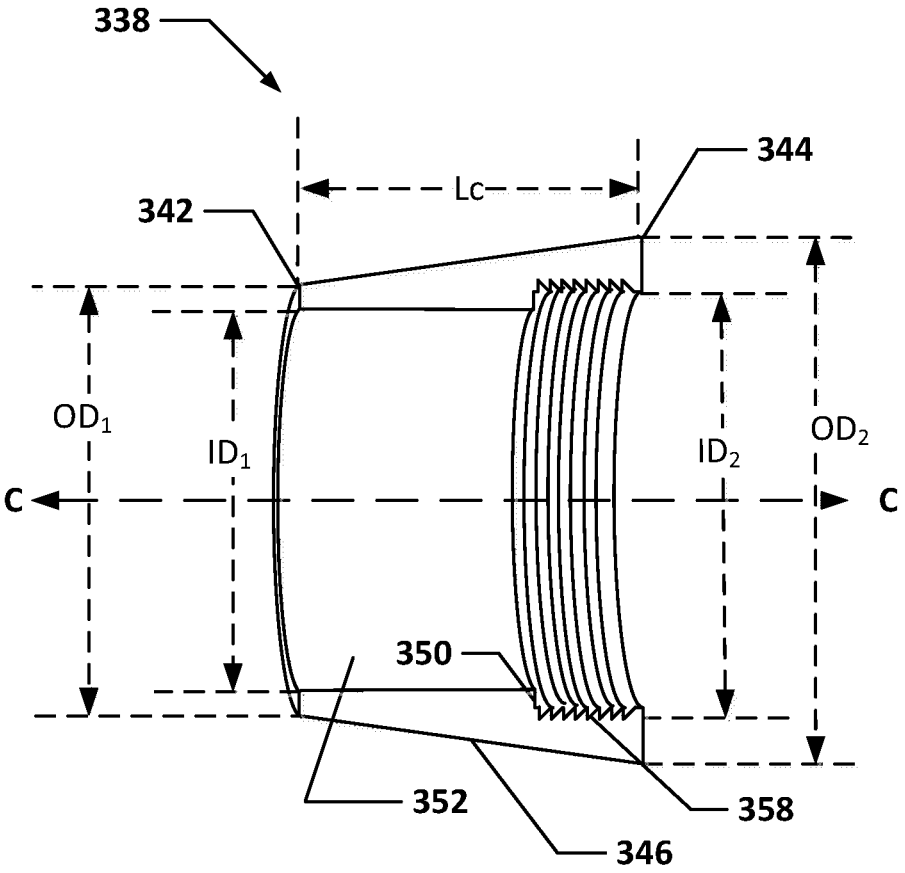
FIG. 5 illustrates a longitudinal cross-sectional view of the tapered split cone of FIG. 4.

In addition, the tubular housing and mandrel include opposing ramped surfaces 338, 340. As illustrated the opposing ramped surfaces are formed from split cones, but the ramped surfaces may also be machined into the mandrel. An example of the split cones, cone 338 is illustrated in FIGS. 4 and 5, which illustrates a cross-section of the cone of FIG. 4 taken along the longitudinal length of the split cone. While not specifically illustrated, cone 340 shares the same features, however in some embodiments, one or more features may exhibit different dimensions. Each split cone includes a central axis C-C along the longitudinal length Lc of the cone. In addition, the cone has a split 348 in it, where the cone may open to expand to accommodate the mandrel OD. A first end of the cone 342 exhibits a first outer diameter $OD_1$ and a second end 344 of the cone exhibits a second outer diameter $OD_2$, which is larger than the first outer diameter $OD_1$. Accordingly, the exterior surface 346 of the split cone tapers at an angle γ of 5° to 15° relative to the central axis C-C, or an axis parallel thereto, as illustrated, including all values and ranges therein such as 10°.

In embodiments, illustrated in FIG. 5, the inner diameter of the split cone transitions, such that the inner diameter of the first end of the cone $ID_1$ is smaller than the inner diameter of the second end of the cone $ID_2$. The transition point between the first inner diameter and the second inner diameter forms a shoulder 350 in the inner surface 352 of the cone. When assembled, the shoulder of the first cone 338 may abut a shoulder 354 (illustrated in FIGS. 3*a* and 3*b*) formed radially around the mandrel and the taper of the first cone extends down towards the central portion 320 of the packing element cartridge 300. The shoulder of the second cone 340 may abut a shoulder 356 (illustrated in FIGS. 3*a* and 3*b*) formed radially around the tubular housing 310, and in preferred embodiments, at the first end 322 of the tubular housing 310. In other embodiments, the inner diameter of the split cone remains constant, without the abutment of shoulders described above.

As illustrated in FIG. 5, buttress thread 358 may be provided on each split cone, which mates with buttress threads 357, 359 provided on the mandrel and tubular housing to lock the split cones in position on the mandrel and the tubular housing. The split cones may also be tacked or welded in position. In other embodiments, the split cone may frictionally fit onto tubular housing, mandrel or both, without longitudinally sliding along the length of the packing element cartridge. Other ramped surfaces may be employed as well and in some embodiments, the ramped surfaces may be machined into the mandrel and tubular housing surfaces.

It may therefore be appreciated that when the mandrel 312 collapses telescopically into the tubular housing 310, the first ramped surface 338 is stationary relative to the mandrel 312 and moves relative to the tubular housing 310 and the second ramped surface 340. On the other hand, when the mandrel 312 is collapsed, the mandrel 312 moves relative to the second ramped surface 340 (or vice versa) and the second ramped surface 340 remains stationary relative to the tubular housing 310.

Figure 3A:
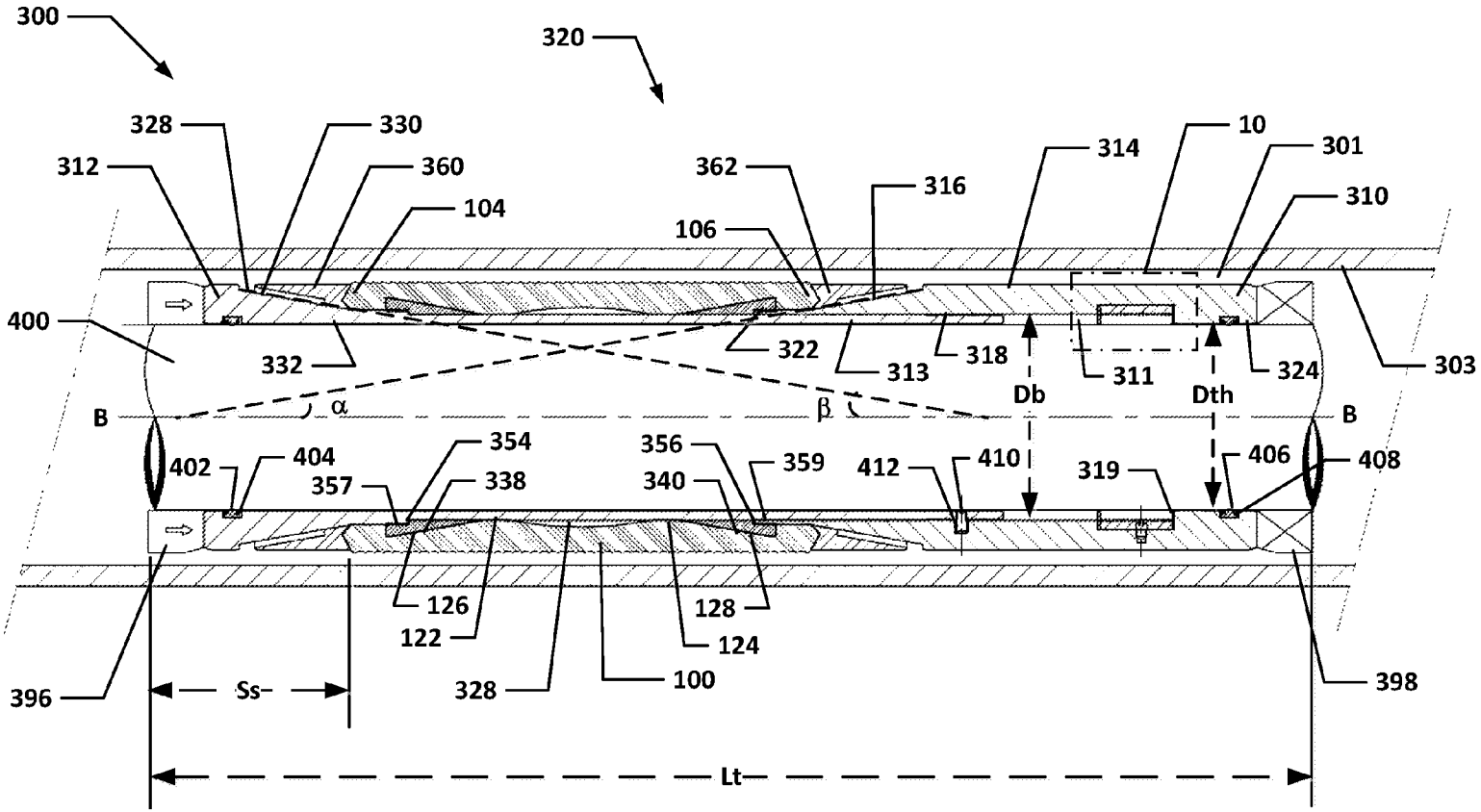
FIG. 3*a* illustrates a longitudinal cross-sectional view of an embodiment of an unset or unactivated packing element cartridge.
Figure 3B:
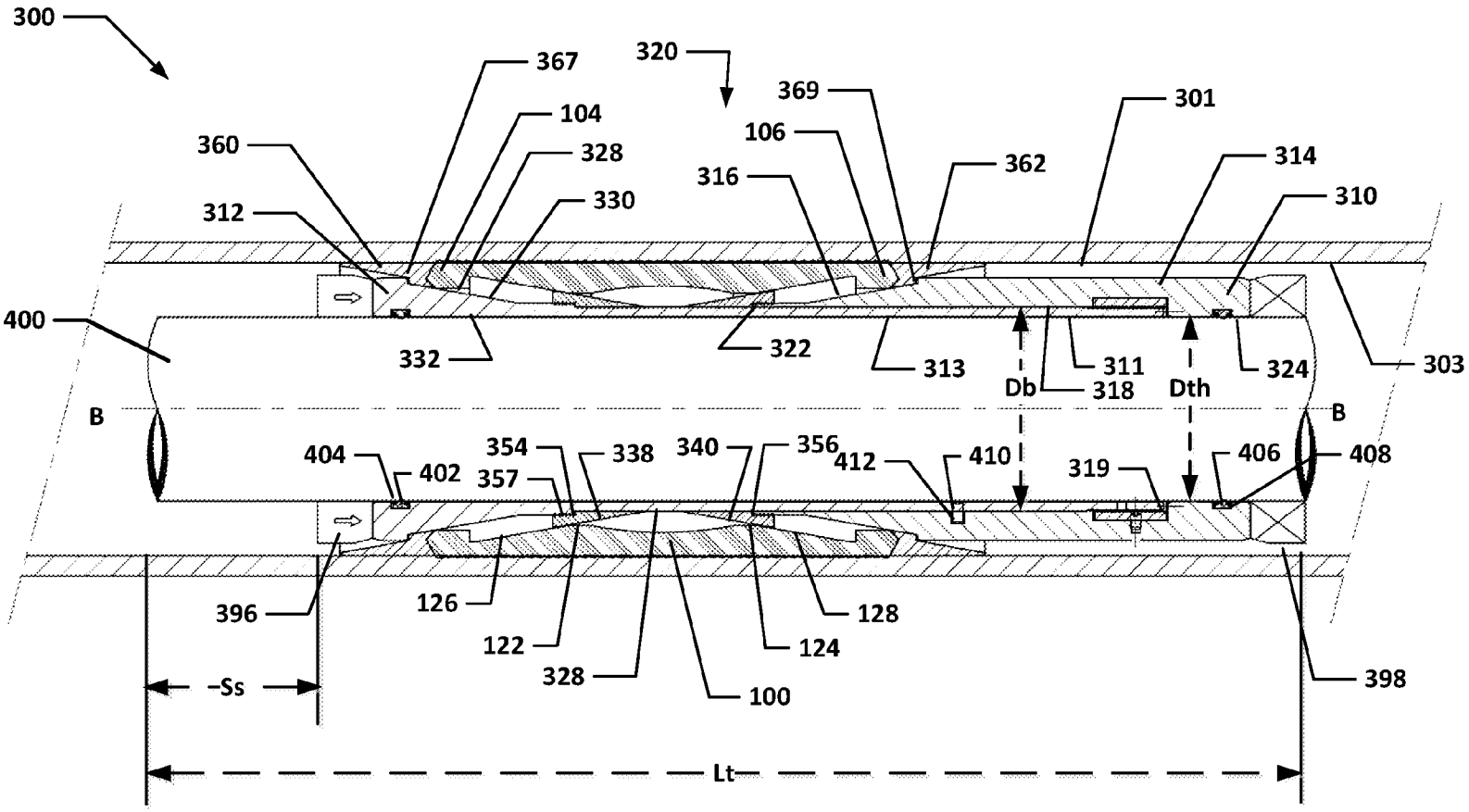
FIG. 3*b* illustrates a longitudinal cross-sectional view of the packing element cartridge of FIG. 3*a* in a set or activated configuration.

In addition, referring again to FIGS. 3*a* and 3*b*, the ramped surfaces interact with the tapered surfaces 126, 128 of the packing element, which is disposed around the mandrel 312 and partially received by the tubular housing 310. In the fully extended position illustrated in FIG. 3*a*, the lands 122, 124 of the packing element may contact the external surface 328 of the mandrel 312 and the ramped surfaces 338, 340 contact the tapered surfaces 126, 128 of the packing element 100. Referring to FIG. 3*b*, as the mandrel 312 is collapsed, or moved longitudinally into the tubular housing 310 along the distance of the setting stroke, the opposing ramped surfaces 338, 340 are moved closer together a distance equal to the length of the setting stroke. The opposing ramped surfaces 338, 340 slide against the tapered surfaces 126, 128 of the packing element causing the thicker portions of the split cones to contact the thicker portions of the tapered portions 126, 128 of the packing element. This expands the packing element 100, forcing the packing element 100 towards and against the wellbore wall 303, and forms a seal between the production pipe and the wellbore.

At each end of the packing element 104, 106 are provided back-ups or radially tapered split rings 360, 362. The split rings may be formed from low alloy steel, such as AISI 4140. In addition, other materials may be used as well such as S13Cr stainless steel, L80 steel, 13% Cr steel, INCONEL 718, etc. The radially tapered split rings may prevent the extrusion or deformation of the packing element into the annulus between the mandrel, or the tubular housing, and the well bore. In addition, the radially tapered split rings may aid in centering the packing element within the borehole. In embodiments, the tapered split rings also improve sealing performance at relatively high pressure, such as in the range of 10 ksi to 25 ksi, including all values and ranges therein, such as from 15 ksi to 22.5 ksi, and achieve sealing in bigger hole sizes, having an expansion in the range of 10% to 20% relative to the gauge diameter, including all values and ranges therein.

Figure 6:
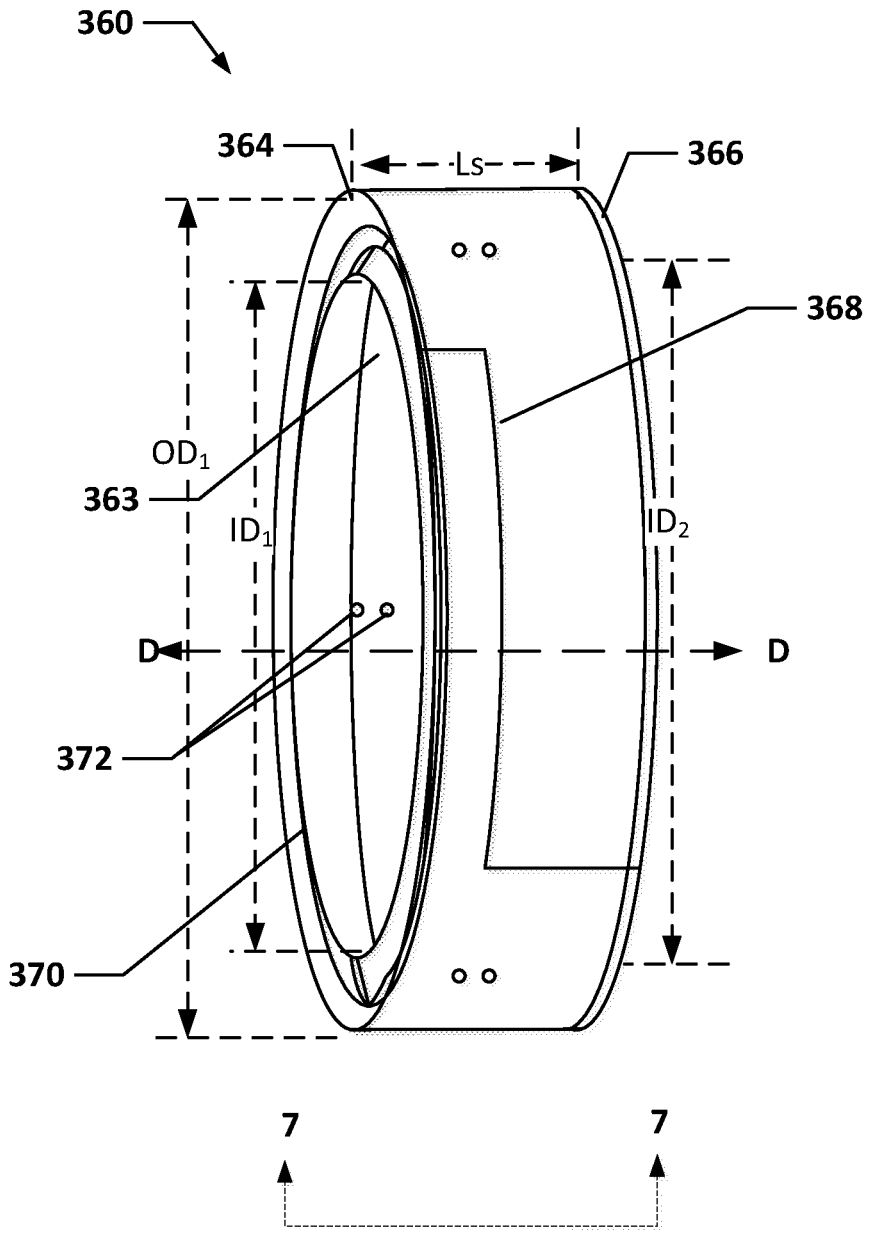
FIG. 6 illustrates a side view of an embodiment of a back-up.
Figure 7:
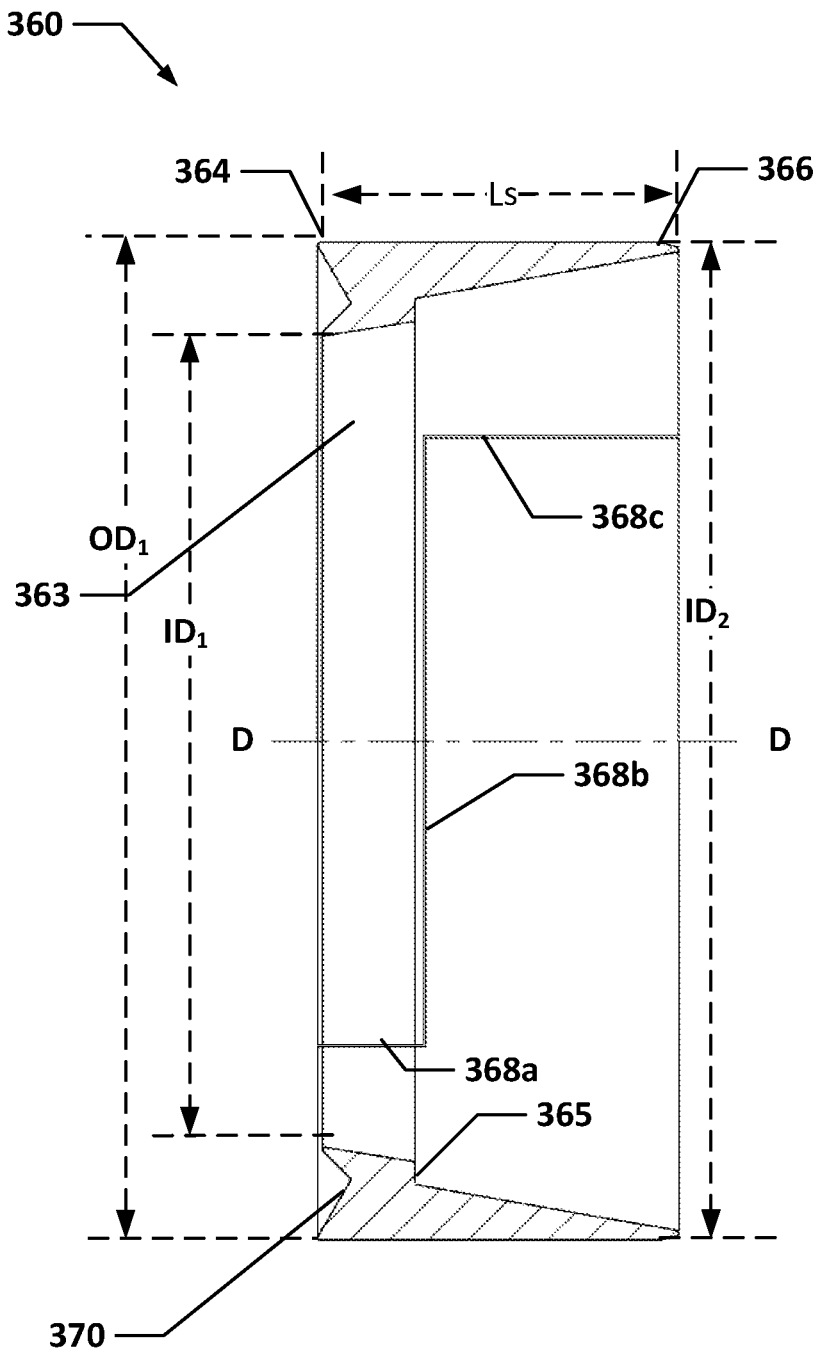
FIG. 7 illustrates a longitudinal cross-sectional view of the back-up of FIG. 6.

FIG. 6 illustrates split ring 360 and FIG. 7 illustrates an embodiment of FIG. 6 taken through cross-section 7-7. While split ring 362 is not illustrated in these figures, the features are the same although in embodiments one or more dimensions of the features may be different. The split ring radially tapers around central axis D-D along the longitudinal length Ls of the ring 362. The outer diameter $OD_1$ of the split ring 360 may remain constant along a substantial portion, if not all, of the longitudinal length Ls of the split ring. The inner surface 363 of the split ring tapers, such that the first inner diameter $ID_1$ of the first end 364 of the split ring is smaller than the second inner diameter $ID_2$ of the second end 366 of the split ring 360. In other words, the split ring has an opening the first end 364 and an opening at the second end 366, which is larger than the opening at the first end 364.

The split ring also includes a step or shoulder 365 in the inner surface 363, which extends radially around the split ring 360, where the inner diameter expands and continues to taper toward the second side 366. The step 365 is positioned 10% to 30% along the longitudinal length Ls, including all values and ranges therein, from the first side 364 of the split ring 360. When the mandrel is collapsed into the tubular housing, the step 365 may engage abutment shoulders 367, 369 provided on the mandrel 312 and tubular housing 310 as illustrated in FIG. 3*b*. The inner diameter taper of the split rings 360, 362 are complementary to the taper of the mandrel 330 and tubular housing 316 respectively, allowing the split rings to slide up and down against the tapers of the mandrel and tubular body, which also provides for expansion and contraction of the packing element 100.

The split ring includes a split 368 from one end 364 to the second end 366 allowing the ring to open and expand as the packing element 100 expands. The split also extends radially around at least a portion of the circumference of the split ring between the first end 364 and the second end 366. As illustrated in FIG. 7, a first portion of the split 368*a* extends longitudinally, parallel to the central axis D-D of the split ring, from the first end 364 and past the step 365 to about 12% to 32% of the longitudinal length Ls of the split ring 360. At this position, a second portion of the split 368*b* extends radially and perpendicular to the central axis D-D around the circumference of the split ring 360 in the range of 10° to 120° around axis D-D, including all values and ranges therein. The third portion of the split 368*c* may continue to extend longitudinally parallel to the central axis D-D to the second end 366 of the split ring.

Or, in further embodiments, the split may form other geometries. For example, the split may extend at an angle to the central axis around the circumference of the split ring and then extend back, wherein the split forms one or more points or fingers. In other embodiments, the split may follow a straight line from the first end to the second end, which may be parallel to or at an angle to the central axis of the split ring. In addition, the split ring 360 includes a mating profile 370 that mates with an end of the packing element (see 104, 106 in FIG. 1*a*) as illustrated. The back-ups may be mechanically or chemically affixed to the packing element, or a combination of mechanical and chemical attachments may be used. For example, mechanical attachment may be provided with screws or pins and chemical attachment may be provided with an adhesive. The radially tapered split rings may also prevent the extrusion or deformation of the packing element into the annulus between the mandrel, or the tubular housing, and the well bore. In addition, the radially tapered split rings may aid in centering the packing element within the borehole.

Figure 8:
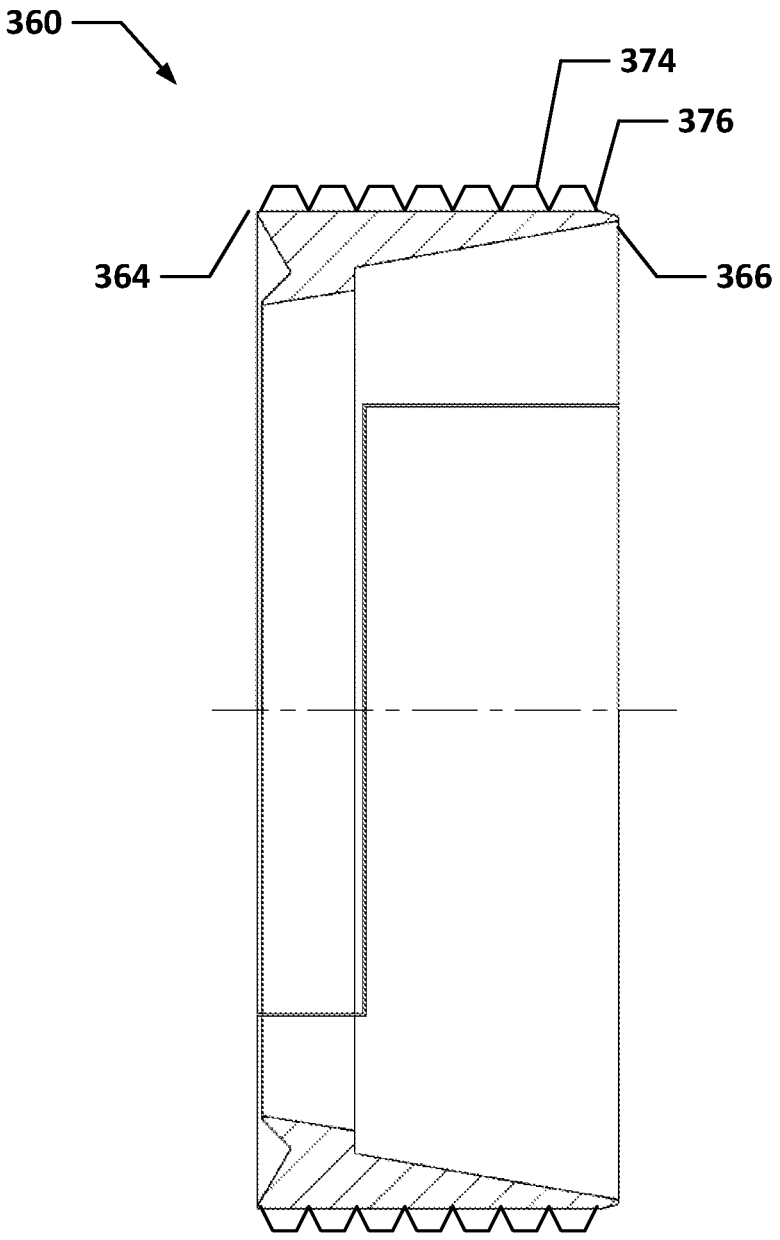
FIG. 8 illustrates a side view of an embodiment of a back-up including hardened teeth.

As illustrated in FIG. 8, the split ring 360 may also include hardened teeth 374 on the exterior surface 376. The hardened teeth 374 may assume a number of geometries, such as cones or polyhedron including pyramids, cubes, tetrahedron, etc., and truncations thereof, such as truncated cones, truncated pyramids, frustums, etc. The hardened teeth 374 may cover all or a portion of the exterior surface 376. In addition, the hardened teeth may exhibit a HRc (Hard Rockwell C) hardness of 55 to 70. In embodiments, the hardness may be from 250% to 388% greater than that of the remainder of the split ring.

Figure 9:
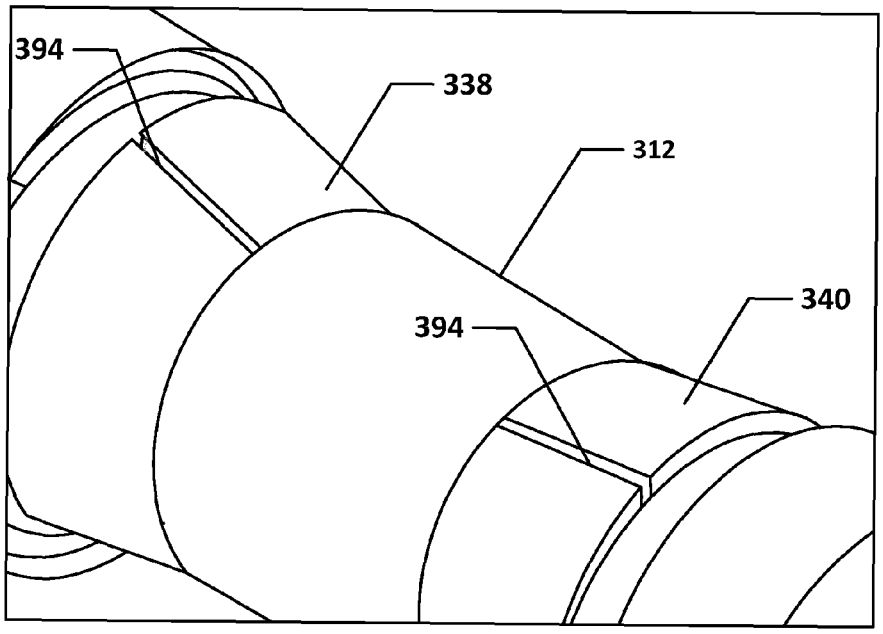
FIG. 9 illustrates a passage way for allowing ingress of fluid between the packing element and the mandrel.

Referring again to FIGS. 3*a* and 3*b*, fluid communication is provided into the cavities 392 formed between the packing element 100 and the mandrel 312 when the packing element is expanded by collapsing the mandrel as illustrated in FIG. 3*b*. In such a manner the fluid may provide additional pressure between the packing element and the wellbore increasing the seal between the packing element and the wall. Increasing fluid pressure behind the packing element cartridge may result in an increase in the fluid pressure behind the packing element in turn increasing the pressure of the fluid in the cavities and acting upon the well bore. As illustrated in FIG. 9, the fluid flows through a passageway 394 defined in the ramped surfaces 338, 340. In the case where the ramped surfaces are formed from split rings, the splits in the split rings may be used to form the passageways.

Specifically, at the pressure side, fluid pressure pushes the packing element in one end until deflection occurs due to compression opening a gap between the packing element and the tapers on the mandrel, allowing the ingress of fluid. Fluid is prevented from flowing out the other side by the packing element sealing against the back-ups and ramped surfaces. The packing element end and the split may expand in the range of 10% to 20% relative to the gauge diameter, including all values and ranges therein, ring at the pressure side and the splits on the split cones.

Piston gauge rings and gauge shoulders 396, 398 may be provided on either end of the packing element cartridge 300. The piston gauge rings may protect the packing element cartridge against damage when running in the hole. Furthermore, the gauge rings provide engagement surfaces for activating and expanding or collapsing the packing element cartridge.

In embodiments, one or more seals are provided between the packing element cartridge 300 and the production pipe 400. As illustrated a first seal 402 is positioned in a first channel 404 defined in the inner surface 332 of the mandrel 312. A second seal 406 is positioned in a second channel 408 defined in the inner surface 318 of the tubular housing 310. The seals may extend out from the channels and contact the production pipe surface. Alternatively, 1, 3 and up to 10 seals may be present along the length of the packing element cartridge 300. The seals may exhibit one of a variety of geometries such as "T" seals, "S" seals, oval seals, square seals, rectangular seals, or other geometries. In preferred embodiments, the seals are "S" seals. In addition, the seals may be formed from an elastomer or a fluoropolymer, such as polytetrafluoroethylene (PTFE), nitrile butadiene rubber (NBR), hydrogenated nitrile butadiene rubber (HNBR), fluoroelastomer (FKM) such as VITON, perfluoroelastomer (FFKM) such as KALREZ, ethylene-propylene-diene-monomer (EPDM), and tetrafluoroethylene-propylene (TFE/P).

A shearable body, such as a shear pin, shear screw, shear ring or shear wire, is provided to retain the packing element in the unset or extended position during run in. It may be appreciated that depending on the size and forces required to run in the packing element cartridge more than one shearable body may be utilized. As illustrated in FIG. 3*a*, the shearable body 410 may extending from a through hole 412 in the mandrel 312 into the tubular housing 310. Alternatively, in embodiments, the shearable body may extend from a through hole in the tubular housing and extend into the mandrel. In embodiments, the shearable body 410 includes threads at one end that mate with threads provided in the mandrel 312 to retain the shearable body 410 in place during transport. In other embodiments, a friction fit may retain the shearable body in place between the tubular housing 310 and the mandrel 312 during transport and run in. Upon setting the packing element cartridge, the shearable element is sheared upon the application of sufficient force so that the mandrel 312 can move relative to the tubular housing 300.

Figure 10:
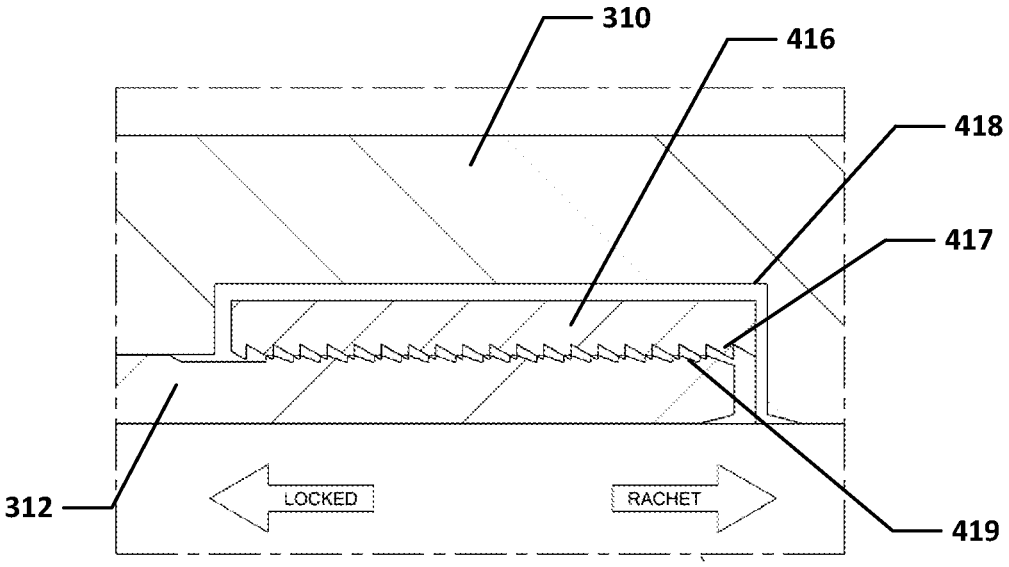
FIG. 10 illustrates an embodiment of a locking ring.

The embodiment illustrated in FIGS. 3*a* and 3*b* may be used in non-retrievable applications where, as illustrated in FIG. 10 (which is a close-up of section 10 in FIG. 3*a*), the packing element cartridge includes a lock ring 416 positioned within a channel 418 defined in the inner surface 318 of the tubular housing 310. When the mandrel 312 is moved in the longitudinal direction along axis B-B of the packing element cartridge and at least partially moved longitudinally into the tubular housing 310, the lock ring 416 engages the mandrel 312 preventing the mandrel 312 from extending out of the tubular housing 310. In embodiments, the body lock ring includes teeth 417, such as buttress thread, which engage mating teeth 419 provided on the mandrel 312, and work as a ratchet allowing motion in one direction but lock against motion in the other direction. In other embodiments, the lock ring may include other mechanical interlocks that mate with interlocks provided in the mandrel 312. This then prevents the mandrel 312 from sliding or extending telescopically out of the tubular housing 310 as it locks the mandrel 312 at a given position along axis B-B.

Figure 11A:
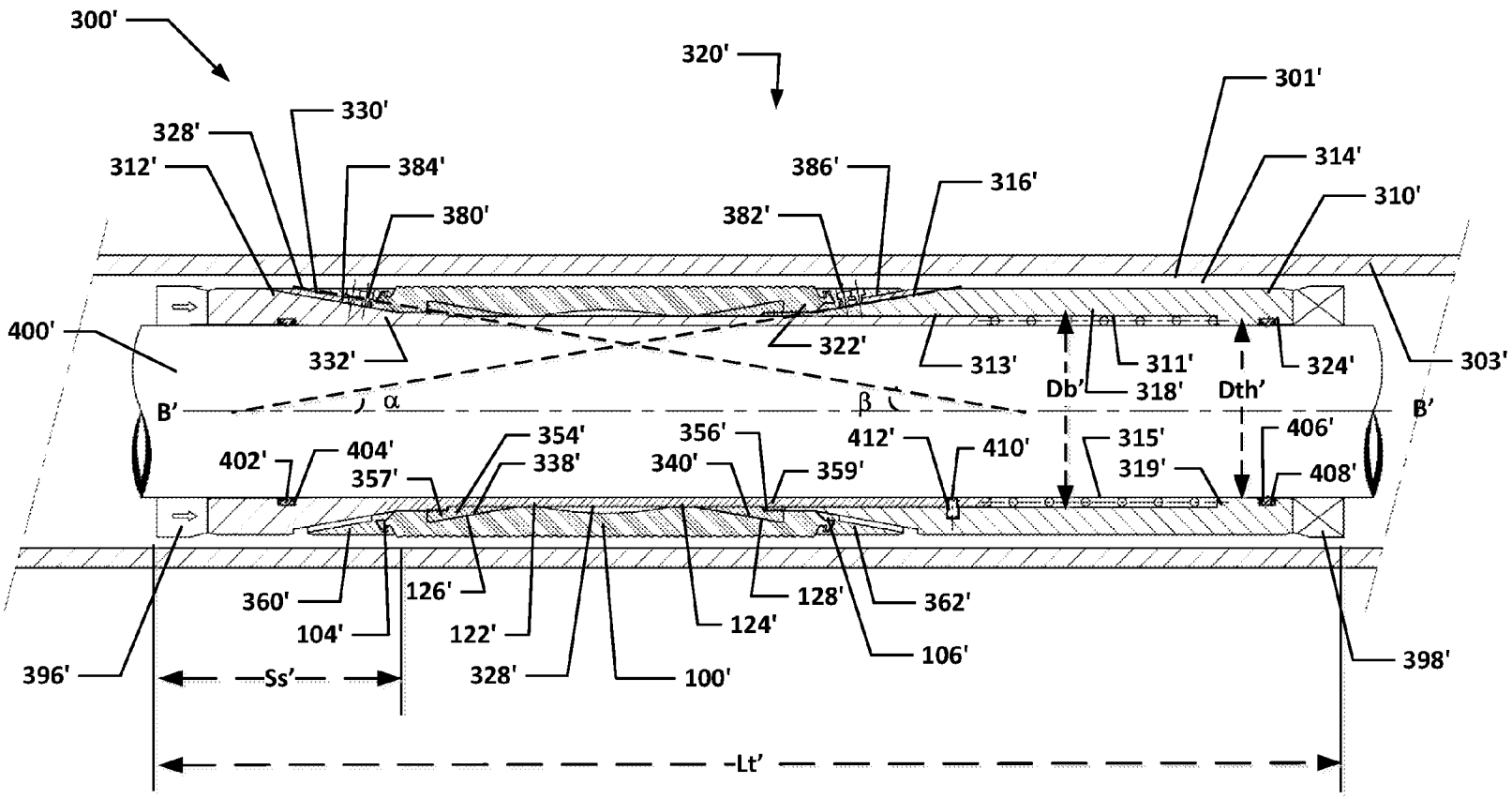
FIG. 11*a* illustrates a longitudinal cross-section of another embodiment of a packing element cartridge for applications where tools require being retrievable.
Figure 11B:
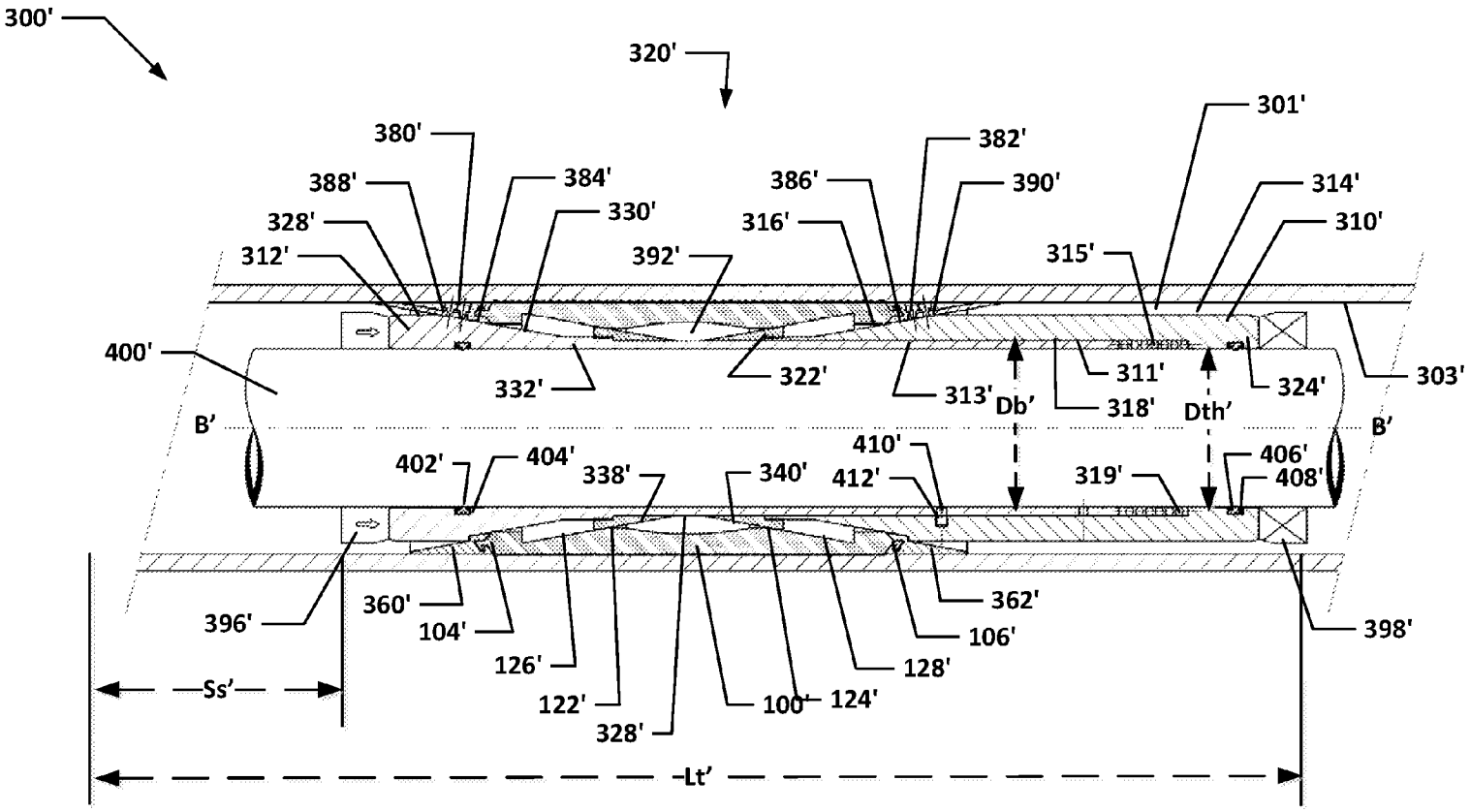
FIG. 11*b* illustrates a longitudinal cross-sectional view of the packing element cartridge of FIG. 11*a* in a set configuration.

FIGS. 11*a* and 11*b* illustrate another embodiment of a packing element cartridge 300', which may be used for retrievable applications within an annulus 301' defined in a well bore 303'. This embodiment may include a number of similar features to that of the embodiment depicted in FIGS. 3*a* and 3*b*. Accordingly, similar to the above configuration, the packing element cartridge 300' includes a tubular housing 310' and a mandrel 312', a portion of which is slidably received in the tubular housing 310'.

In embodiments, the tubular housing 310' defines an expanded bore 311' having a larger diameter Db' than the diameter Dth' of the remainder of the tubular housing 310', which receives the mandrel 312'. The bore 311' may be open to the inner diameter of the tubular housing 310' forming a portion of the interior surface 318' and a shelf 319' on the interior surface as illustrated. Alternatively, an elongated channel may be provided, wherein a wall separates the elongated channel from the inner diameter of the tubular housing and the wall forms the interior surface. The mandrel also includes an elongated hollow shaft 313' that fits within the expanded bore 311', between the interior surface 318' of the tubular housing 310' and the production pipe 400'.

Again, the mandrel 312' slides telescopically collapsing, at least in part, further into the tubular housing 310' when the packing element cartridge 300' set into place in the wellbore and set. When deployed the mandrel 312' collapses and moves longitudinally along axis B'-B' relative to the tubular housing 310', reducing the length of the packing element cartridge 300'. For example, the setting stroke Ss', the distance that the mandrel travels into the tubular housing, may be up to 20% of the overall length Lt' of the packing element cartridge 300' when fully expanded, including all values and ranges therein, such as 1% to 20%. The materials used in this embodiment are the same or similar to those described above.

In retrievable embodiments, a spring 315' is provided between the shelf 319' of the tubular housing 310' and the end of the mandrel 312'. As the mandrel 312' is collapsed into the tubular housing 310', the spring 315' is compressed. The spring may include for example a coil spring or a machined spring. A mechanical interlock may be provided to prevent the spring from prematurely forcing the mandrel 312' back out of the housing. In one embodiment, the shear pin 410' provided in a through hole 412' in the mandrel 312' described above, may be replaced with a relatively high tensile set screw or hardened dowel pin to hold the spring in a compressed manner when deployed. In addition, or alternatively, the packing element 100' may pre-compress the spring 315' before the packing element cartridge 300' is compressed via the guides described further herein. Accordingly, the spring 315' may be pre-compressed during assembly of the packing element 100' and prior to running the packing element cartridge downhole.

In addition, similar to the above non-retrievable embodiments, retrievable embodiments include the exterior surface 314' of the tubular housing includes taper 316' around the radius of the tubular housing 310' extending towards in interior surface 318' and the central portion 320' of the packing element cartridge. In such a manner a first end 322' of the tubular housing 310' has a smaller thickness than the opposing second end 324'. The exterior surface 328' of the mandrel 312' also includes a taper 330' around the radius of the mandrel 312' extending towards the interior surface 332' and central portion 320' of the packing element cartridge. The tapers 316', 330' are disposed at opposing angles α', β', respectively, in the range of 5° to 15° relative to the central axis B'-B'. Angles α', β' may be the same or different.

The tubular housing and mandrel include ramped surfaces 338', 340', which may be formed from split cones such as those previously described with reference to FIGS. 4 and 5 above, or may be machined directly into the mandrel and tubular housing. As described with regard to the above non-retrievable embodiment when the mandrel 312' collapses telescopically, moving longitudinally, into the tubular housing 310', the first ramped surface 338' is stationary relative to the mandrel 312' and moves relative to the tubular housing 310'. On the other hand, when the mandrel 312' is collapsed, the mandrel 312' moves relative to the second ramped surface 340' (or vice versa) and the second ramped surface 340' remains stationary relative to the tubular housing 310'.

Also similar to the above, referring again to FIGS. 11*a* and 11*b*, the ramped surfaces 338', 340' interact with the tapered surfaces 126', 128' of the packing element 100', which is disposed around the mandrel 312' and partially received by the tubular housing 310'. In the fully extended position illustrated in FIG. 11*a*, the lands 122', 124' of the packing element may contact the external surface 328' of the mandrel 312' and the ramped surfaces 338', 340' contact the tapered surfaces 126', 128' of the packing element 100'. Referring to FIG. 11*b*, as the mandrel 312' is collapsed, or moved longitudinally into the tubular housing 310' along the distance of the setting stroke, the opposing ramped surfaces 338', 340' are moved closer together by a distance equal to the length of the setting stroke. The opposing ramped surfaces slide against the tapered surfaces of the packing element causing the thicker portions of the split cones to contact the thicker portions of the packing element. This expands the packing element 100', forcing the packing element 100' towards and against the wellbore wall 303', and forms a seal between the production pipe and the wellbore.

In retrievable embodiments, when tension is applied to an end of the packing element cartridge 300' and the packing element 100' (such as through the guides discussed further below), the mandrel 312' is pulled at least partially out from the tubular housing 310'. The distance between the ramped surfaces 338', 340' increases and the tapered surfaces 126', 128' of the packing element 100' slide back down along the ramped surfaces 338', 340'. This reduced the diameter of the packing element 100', which contracts away from the wellbore 303' and towards the mandrel 312'.

Figure 12:
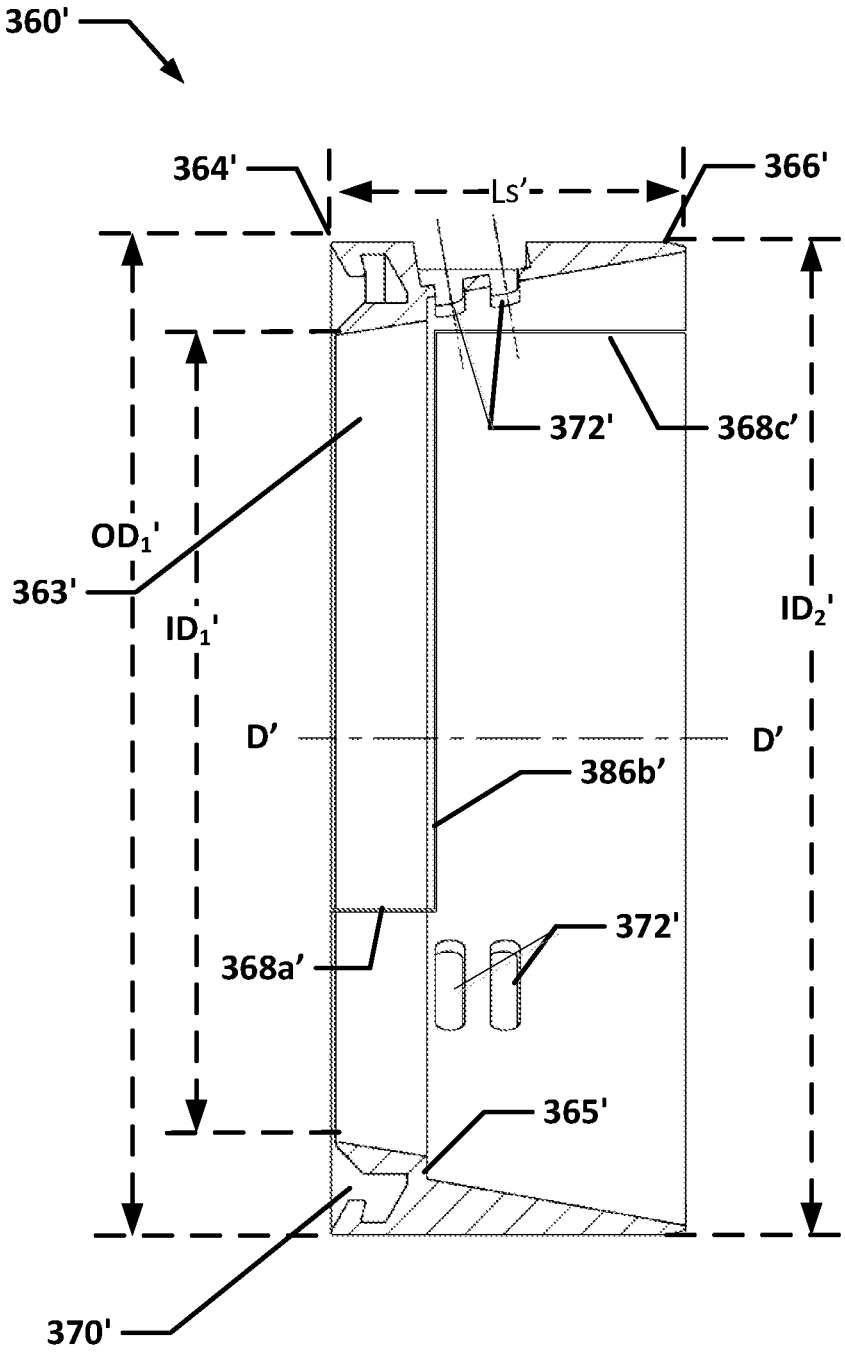
FIG. 12 illustrates a cross-sectional view of an embodiment of a back-up.

Again, at each end of the packing element 104', 106' is provided a back-up or radially tapered split ring 360', 362', which are described above with reference to FIGS. 6 and 7. FIG. 12 illustrates another embodiment of a split ring 360'. While split ring 362' is not illustrated in these figures, the features are the same although in embodiments one or more dimensions of the features may be different. Similar to above, the split ring radially tapers around central axis D'-D' along the longitudinal length Ls' of the ring 362'. The outer diameter $OD_1$' of the split ring 360' may remain constant along a substantial portion, if not all, of the longitudinal length Ls' of the split ring. The inner surface 363' of the split ring tapers, such that the first inner diameter $ID_1$' of the first end 364' of the split ring is smaller than the second inner diameter $ID_2$' of the second end 366' of the split ring 360'. In other words, the split ring has an opening at the first end 364' and an opening at the second end 366', which is larger than the opening at the first end 364'.

Again, the split ring also includes a step or shoulder 365' in the inner surface 363', which extends radially around the split ring 360', where the inner diameter expands and continues to taper toward the second side 366'. The step 365' is positioned 10% to 30% along the longitudinal length Ls', including all values and ranges therein, from the first side 364' of the split ring 360'. The inner diameter taper of the split rings 360', 362' are complementary to the taper of the mandrel 330' and tubular housing 316' respectively, allowing the split rings to slide up and down against the tapers of the mandrel and tubular body, which also provides for expansion and contraction of the packing element 100'.

Also, again, the split ring includes a split 368' from one end 364' to the second end 366' allowing the ring to open and expand as the packing element 100' expands. The split also extends radially around at least a portion of the circumference of the split ring between the first end 364' and the second end 366'. As illustrated in FIG. 12, a first portion of the split 368*a*' extends longitudinally, parallel to the central axis D'-D' of the split ring, from the first end 364' and past the step 365' to about 12% to 32% of the longitudinal length Ls' of the split ring 360'. At this position, a second portion of the split 368*b*' extends radially and perpendicular to the central axis D'-D' around the circumference of the split ring 360' in the range of 10° to 120° around axis D'-D', including all values and ranges therein. The third portion of the split 368*c*' may continue to extend longitudinally parallel to the central axis D'-D' to the second end 366' of the split ring.

Or, in further embodiments, the split may form other geometries. For example, the split may extend at an angle to the central axis around the circumference of the split ring and then extend back, wherein the split forms one or more points or fingers. In other embodiments, the split may follow a straight line from the first end to the second end, which may be parallel to or at an angle to the central axis of the split ring.

In addition, the split ring 360' includes a mating profile 370' that mates with an end of the packing element latch hooks 136', 138' (illustrated in FIG. 1*b*) extending from the packing element 100' allowing tension or compression to be applied to the packing element 100'. Furthermore, in embodiments, as illustrated in FIG. 12, the split ring 360' includes attachment holes 372' for attaching the split ring 360' to one or more guides (described further herein). The attachment holes 372' may be relatively oblong, as illustrated, to accommodate for expansion of the split ring and circumferential movement of the split ring and packing element relative to the mandrel. As illustrated, six (6) attachment holes are provided to accommodate three guides spaced radially at equal intervals around the split ring 360' and central axis D'-D'. Alternatively, other mechanical fasteners may be used to mate with the guides, such as interlocking projections, or the guides may be integrally formed with the split ring. Fewer or additional guides may be provided for depending on the size of the packing element cartridge spaced equally, or non-equally, around the radius of the packing element cartridge 300'. However, in preferred embodiments, at least three guides are provided. The radially tapered split rings may also prevent the extrusion or deformation of the packing element into the annulus between the mandrel, or the tubular housing, and the well bore. In addition, the radially tapered split rings may aid in centering the packing element within the borehole.

Figure 13:
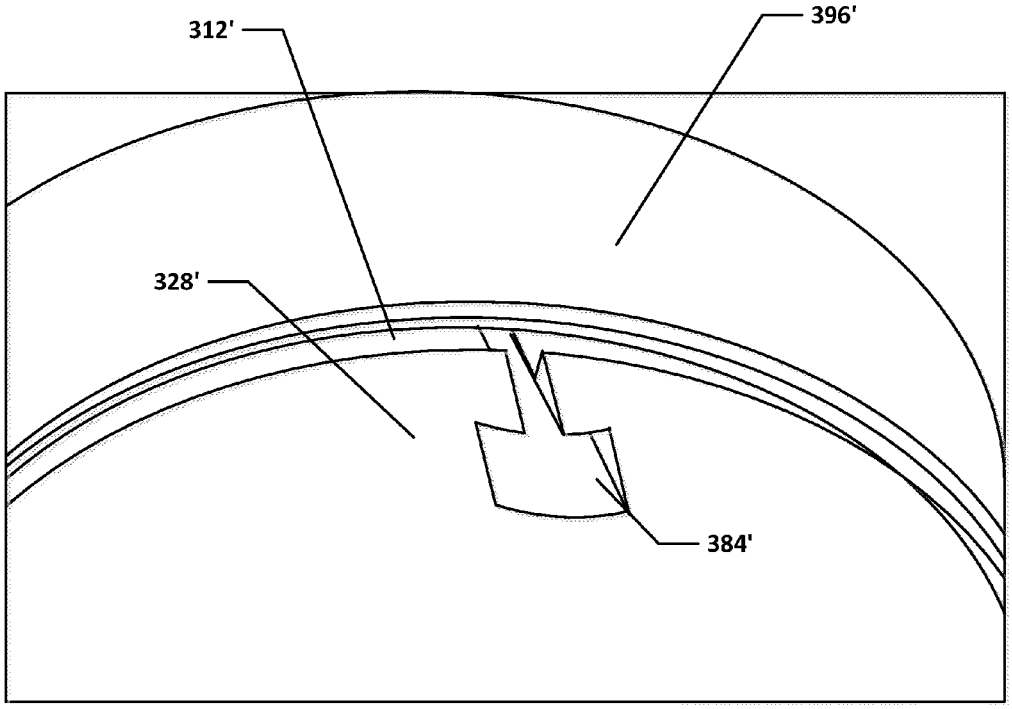
FIG. 13 illustrates an embodiment of a guide track in the mandrel.

As alluded to above, the split rings 360', 362' are again affixed to guides 380', 382' that ride in tracks 384', 386' or channels defined in the exterior surface 328' of the mandrel 312' as illustrated in FIG. 13 and exterior surface 314' of the tubular housing 310', respectively. Referring again to FIGS. 11*a*, 11*b*, the guides 380', 382' function to hold the split back-up ring down against the mandrel during retrieval, in addition, they may help keep the packing element centered over the mandrel 312' and tubular housing 310'. Furthermore, the guides 380', 382' apply tension to the ends of the packing element, such as when the mandrel 312' is being pulled out of the tubular housing 310'.

Similar to the above embodiments of FIGS. 3*a* and 3*b*, fluid communication is provided into the cavities 392' formed between the packing element 100' and the mandrel 312' when the packing element is expanded by collapsing the mandrel as illustrated in FIG. 11*b*. In such a manner the fluid may provide additional pressure between the packing element and the wellbore increasing the seal between the packing element and the wall. Increasing fluid pressure behind the packer may result in an increase in the fluid pressure behind the packing element in turn increasing the pressure of the fluid in the cavities and acting upon the well bore. The fluid flows through a passageway, as illustrated above in FIG. 9, defined by the space between the element end and the split backup ring at the pressure side and the splits on the split cones. This allows the ingress of fluid beneath the element and into the cavities. Pressure applied by the fluid on the packing element seals the element against the other end.

Again, in embodiments, one or more seals are provided between the packing element cartridge 300' and the production pipe 400'. As illustrated a first seal 402' is positioned in a first channel 404' defined in the inner surface 332' of the mandrel 312'. A second seal 406' is positioned in a second channel 408' defined in the inner surface 318' of the tubular housing 310'. The seals may extend out from the channels contacting the production pipe surface. Alternatively, 1, 3 and up to 10 seals may be present along the length of the packing element cartridge 300'. The seals may exhibit one of a variety of geometries such as "S" seals, oval seals, square seals, rectangular seals, or other geometries. In preferred embodiments, the seals are "S" seals. In addition, the seals may be formed from an elastomer or a fluoropolymer, such as polytetrafluoroethylene (PTFE), nitrile butadiene rubber (NBR), hydrogenated nitrile butadiene rubber (HNBR), fluoroelastomer (FKM) such as VITON, perfluoroelastomer (FFKM) such as KALREZ, ethylene-propylene-diene-monomer (EPDM), and tetrafluoroethylene-propylene (TFE/P).

Further, as described above, a shearable body 410', such as a shear pin, shear screw, shear ring or shear wire, is provided to retain the packing element in the unset or extended position during run in. It may be appreciated that depending on the size and forces required to run in the packing element cartridge more than one shearable body may be utilized. As illustrated in FIG. 11*a*, the shearable body 410' extends from a through hole 412' in the mandrel 312' and into the tubular housing 310'. Alternatively, the shearable body may extend from a through hole in the tubular housing and into the mandrel. In embodiments, the shearable body 410' includes threads at one end that mate with threads provided in the mandrel 312' to retain the shearable body 410' in place during transport. In other embodiments, a friction fit may retain the shearable body in place between the tubular housing 310' and the mandrel 312' during transport and run in. Upon setting the packing element cartridge, the shearable element is sheared upon the application of sufficient force so that the mandrel 312' can move relative to the tubular housing 310'. Alternatively, as noted above, the shearable body provided in a through hole 412' in the mandrel 312' described above, may be replaced with a relatively high tensile set screw or hardened dowel pin to hold the spring in a compressed manner.

As may be understood from the above, a number of elements between the retrievable and non-retrievable assemblies are shared. Therefore, by changing a few of the elements, e.g., providing or removing a compression spring and removing or providing a locking ring, respectively, the packing element cartridge may be easily converted between retrievable or non-retrieval assemblies.

A method of deploying the packing element cartridge described above is also provided, including running a packing element cartridge in the annulus between a wellbore and production pipe, using an appropriate deployment tool. The packing element cartridge may be deployed as a standalone tool mounted on tubing or run mounted on a downhole tool including packers, plugs, hangers, etc. The setting tool is therefore capable of applying stroke with a minimum setting force. In embodiments, the wellbore includes a liner or a casing and the packing element cartridge is run in between the production pipe and said liner or casing. The packing element cartridge is set by applying a force against the mandrel, moving the mandrel longitudinally into the tubular body and expanding the packing element. Force may be applied by a piston built in a downhole tool where the packing element cartridge is assembled. Stated another way, the setting device forms a part of the tool that the cartridge is mounted on. The method of deploying may include shearing any shearable bodies present between the tubular housing and the mandrel. Once the packing element cartridge is deployed and cavities are formed between the packing element and the mandrel, the cavities are filled with fluid, such as the gas or oil that is being produced by the well.

In further embodiments, the packing element cartridge may be removed from the well. Tension may be applied to the packing element cartridge so as to extend the mandrel relative to the tubular housing, collapsing the packing element and unsetting the packing element cartridge.

The packing element cartridge may be used in well bores for zonal isolation, including fracking, production and injection applications, gravel packing, annular barriers for sand screens and annual barriers for inflow control devices and plugs. Thus, also provided herein is a packing element cartridge as described in the above embodiments, included in a well bore, and particularly within an annulus that is defined within the well bore, such as an annulus defined between 1) between the bore itself and a casing or production pipe or 2) between casings or casing and production pipe. In addition, due to the ability to use fluoropolymers as the packing elements, the packing elements and, therefore, the packing element cartridge may withstand cryogenic temperatures as well as higher temperatures than most of elastomeric elements at lower cost. In some embodiments, the packing element cartridge described herein may also be mounted directly to the production tubing. In such a manner as the tubing is fed into the wellbore, the packing element cartridge is fed with the tubing.

The modular design of the expandable packing element cartridge described herein allows for pre-assembly of the packing element with backup system and carrier body, which may be slid into place as a cartridge of the tool (cartridge) and retained by a fixed body and a linear actuator (piston, sliding sleeve, or other) to set the element by compressing the cartridge. This may simplify the assembly procedure, which is made in a separate process, and facilitates field re-dress. Furthermore, the need for additional slip cone systems may be eliminated, particularly in embodiments where hardened teeth are provided on the back-ups, in a packing element cartridge, plug or hanger.

It may be appreciated that the present disclosure is not limited in its application to the details of construction and the arrangement of components set forth in the following description or illustrated in the drawings. The embodiments herein may be capable of other embodiments and of being practiced or of being carried out in various ways. Also, it may be appreciated that the phraseology and terminology used herein is for the purpose of description and should not be regarded as limiting. Reference to first, second, etc., are for purposes of clarity and do not necessarily imply any particular order. In addition, the components of the individual embodiments described herein are interchangeable with components of any the other embodiments described above.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A packing element cartridge comprising:

a tubular housing having a longitudinal length;

a mandrel including a first ramped surface and a first portion that is positioned within said tubular housing and is slidable longitudinally relative to said tubular housing, wherein said tubular housing includes a second ramped surface opposing said first ramped surface;

a packing element disposed around said mandrel, wherein said packing element includes a tube having a longitudinal length including:

a first end and a second end opposing said first end;

an external portion including a plurality of circumferential ribs; and an internal portion opposing said external portion, wherein said internal portion includes i) a central portion between said first end and said second end including a relief, ii) a first tapered portion radially tapering along the longitudinal length from said central portion towards said first end of said tube, and iii) a second tapered portion tapering along the longitudinal length from said central portion towards said second end of said tube, wherein said first tapered portion and said second tapered portion slidably contact said ramped surfaces, and wherein upon moving said mandrel longitudinally into said tubular housing, a distance between said ramped surfaces decreases and said tapered portions slide up said ramped surfaces, radially expanding said packing element, and upon moving said mandrel longitudinally out of said tubular housing, the distance between said ramped surfaces increases and said tapered portions slide down said ramped surfaces, radially contracting said packing element.

2. The packing element cartridge of claim 1, further comprising passageways providing fluid communication between an exterior portion of said tubular housing and cavities formed between said packing element and said mandrel when said packing element is expanded.

3. The packing element cartridge of claim 1, further comprising a shearable body retained in said mandrel and said tubular housing.

4. The packing element cartridge of claim 1, wherein said tubular housing further comprises a lock ring, wherein when said mandrel is collapsed said lock ring engages with said mandrel.

5. The packing element cartridge of claim 1, wherein said tubular housing includes a radial seal, which extends inwardly from said tubular housing.

6. The packing element cartridge of claim 1, wherein said mandrel includes a radial seal, which extends inwardly from said mandrel.

7. The packing element cartridge of claim 1, further comprising a spring retained between a first end of said mandrel and a shoulder defined in an interior wall of said tubular housing.

8. The packing element cartridge of claim 1, wherein said packing element comprises a first end and a second end, a first radially tapered split ring affixed to said first end, and a second radially tapered split ring affixed to said second end.

9. The packing element cartridge of claim 8, wherein said first radially tapered split ring and said second radially tapered split ring each include a circumference and a split that extends longitudinally from a first end of said split ring to a second end of said split ring and extends radially around at least a portion of the circumference of said split ring.

10. The packing element cartridge of claim 8, wherein said first tapered ring includes a first abutment face and said mandrel includes a stop shoulder, which contacts said first abutment face when radial expansion of said packing element cartridge element reaches a maximum.

11. The packing element cartridge of claim 8, wherein said second tapered ring includes a second abutment face and said tubular housing includes a stop shoulder, which contact said second abutment face when radial expansion of said packer element reaches a maximum.

12. The packing element cartridge of claim 8, further comprising a first guide affixed to said first tapered ring and a first guide channel provided in said mandrel.

13. The packing element cartridge of claim 8, further comprising a second guide affixed to said second tapered ring and a second guide channel provided in said tubular housing.

14. The packing element cartridge of claim 1, further comprising a circumferential hook latch profile provided at one or both of said first end and said second end of said tube.

15. The packing element cartridge of claim 1, wherein said internal portion further comprises lands between central portion and said first proximal portion and said second proximal portion.

16. The packing element cartridge of claim 1, wherein said tube is formed from an elastomer.

17. The packing element cartridge of claim 1, wherein said tube is formed from a fluoropolymer.

18. A method of deploying a packing element cartridge, comprising:

running a packing element cartridge in an annulus between a well bore and production pipe, wherein said packing element cartridge includes a tubular housing having a longitudinal length;

a mandrel, including a first ramped surface and a first portion that is positioned within said tubular housing and is slidable longitudinally relative to said tubular housing, wherein said tubular housing includes a second ramped surface opposing said first ramped surface;

a packing element disposed around said mandrel, wherein said packing element includes a tube having a longitudinal length including:

a first end and a second end opposing said first end, an external portion including a plurality of circumferential ribs; and an internal portion opposing said external portion, wherein said internal portion includes i) a central portion between said first end and said second end including a relief, ii) a first tapered portion radially tapering along the longitudinal length from said central portion towards said first end, and iii) a second tapered portion tapering along the longitudinal length from said central portion towards said second end, wherein said first tapered portion and said second tapered portion slide-ably contact said ramped surfaces; and moving said mandrel longitudinally into said tubular housing, whereupon a distance between said ramped surfaces decreases and said tapered portions slide up said ramped surfaces, radially expanding said packing element.

19. The method of claim 18, wherein said wellbore includes a liner, open hole or a casing and said packing element cartridge is run in between said production pipe and said liner or casing.

20. The method of claim 18, further comprising forming cavities between said packing element and said mandrel and filling said cavities with fluid.

21. The method of claim 18, wherein said packing element cartridge further comprises a shearable body retained in said mandrel and said tubular housing and upon collapsing said mandrel, said shearable body shears.

22. The method of claim 18, wherein said packing element cartridge further comprises a spring retained between a first end of said mandrel and a shoulder defined in an interior wall of said tubular housing, wherein upon collapsing said mandrel said spring is compressed.

23. A well bore, comprising:

a well bore annulus;

a packing element cartridge placed within said annulus, the packing element cartridge including:

a tubular housing having a longitudinal length;

a mandrel including a first ramped surface and a first portion that is positioned within said tubular housing and is slidable longitudinally relative to said tubular housing, wherein said tubular housing includes a second ramped surface opposing said first ramped surface;

a packing element disposed around said mandrel, wherein said packing element includes a tube having a longitudinal length including:

a first end and a second end opposing said first end;

an external portion including a plurality of circumferential ribs; and an internal portion opposing said external portion, wherein said internal portion includes i) a central portion between said first end and said second end including a relief, ii) a first tapered portion radially tapering along the longitudinal length from said central portion towards said first end of said tube, and iii) a second tapered portion tapering along the longitudinal length from said central portion towards said second end of said tube, wherein said first tapered portion and said second tapered portion slidably contact said ramped surfaces, and wherein upon moving said mandrel longitudinally into said tubular housing, a distance between said ramped surfaces decreases and said tapered portions slide up said ramped surfaces, radially expanding said packing element, and upon moving said mandrel longitudinally out of said tubular housing, the distance between said ramped surfaces increases and said tapered portions slide down said ramped surfaces, radially contracting said packing element.

24. A method of deploying a packing element cartridge, comprising:

feeding a packing element cartridge with production pipe into a wellbore, wherein said packing element cartridge includes a tubular housing having a longitudinal length;

a mandrel, including a first ramped surface and a first portion that is positioned within said tubular housing and is slidable longitudinally relative to said tubular housing, wherein said tubular housing includes a second ramped surface opposing said first ramped surface;

a packing element disposed around said mandrel, wherein said packing element includes a tube having a longitudinal length including:

a first end and a second end opposing said first end, an external portion including a plurality of circumferential ribs; and an internal portion opposing said external portion, wherein said internal portion includes i) a central portion between said first end and said second end including a relief, ii) a first tapered portion radially tapering along the longitudinal length from said central portion towards said first end, and iii) a second tapered portion tapering along the longitudinal length from said central portion towards said second end, wherein said first tapered portion and said second tapered portion slide-ably contact said ramped surfaces; and moving said mandrel longitudinally into said tubular housing, whereupon a distance between said ramped surfaces decreases and said tapered portions slide up said ramped surfaces, radially expanding said packing element.

25. The method of claim 24, wherein said wellbore includes a liner, open hole or a casing and said packing element cartridge is run in said liner or casing.

26. The method of claim 24, further comprising forming cavities between said packing element and said mandrel and filling said cavities with fluid.

27. The method of claim 24, wherein said packing element cartridge further comprises a shearable body retained in said mandrel and said tubular housing and upon collapsing said mandrel, said shearable body shears.

28. The method of claim 24, wherein said packing element cartridge further comprises a spring retained between a first end of said mandrel and a shoulder defined in an interior wall of said tubular housing, wherein upon collapsing said mandrel said spring is compressed.

* * * * *